US006568406B2

(12) United States Patent
Aichinger et al.

(10) Patent No.: US 6,568,406 B2
(45) Date of Patent: May 27, 2003

(54) METHOD OF CLEANING PLANT PARTS FOR THE PREPARATION OR PROCESSING OF (METH)ACRYLIC ESTERS

(75) Inventors: Heinrich Aichinger, Mannheim (DE); Holger Herbst, Frankenthal (DE); Gerhard Nestler, Ludwigshafen (DE); Jürgen Schröder, Ludwigshafen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/509,817

(22) PCT Filed: Oct. 21, 1998

(86) PCT No.: PCT/EP98/06677

§ 371 (c)(1),
(2), (4) Date: Apr. 18, 2000

(87) PCT Pub. No.: WO99/20595

PCT Pub. Date: Apr. 29, 1999

(65) Prior Publication Data

US 2002/0195126 A1 Dec. 26, 2002

(30) Foreign Application Priority Data

Oct. 22, 1997 (DE) ..... 197 46 688

(51) Int. Cl.[7] ..... G08B 9/00

(52) U.S. Cl. ..... 134/22.13; 134/2; 134/22.11; 134/22.1; 134/16; 134/17; 134/25.1

(58) Field of Search ..... 134/8, 10, 19, 134/22.1, 22.11, 22.13, 22.17, 34, 42, 16, 17, 25.1

(56) References Cited

U.S. PATENT DOCUMENTS

| | | | | | |
|---|---|---|---|---|---|
| 3,865,628 | A | * | 2/1975 | Callahan et al. | 134/2 |
| 4,209,343 | A | * | 6/1980 | Lane et al. | 134/22.12 |
| 4,409,119 | A | * | 10/1983 | Burger et al. | 252/156 |
| 4,468,257 | A | * | 8/1984 | Kaneko et al. | 134/22.13 |
| 4,591,391 | A | * | 5/1986 | Shimizu et al. | 134/22.17 |
| 4,664,836 | A | * | 5/1987 | Taylor, Jr. et al. | 252/91 |
| 4,904,309 | A | * | 2/1990 | Komabashiri et al. | 134/42 |
| 4,935,065 | A | * | 6/1990 | Bull | 134/22.13 |
| 4,952,247 | A | * | 8/1990 | Schrader et al. | 134/22.12 |
| 5,064,487 | A | * | 11/1991 | Fourne | 156/155 |
| 5,128,446 | A | * | 7/1992 | Hayashi et al. | 528/501 |
| 5,346,626 | A | * | 9/1994 | Momozaki et al. | 134/22.19 |
| 5,487,836 | A | * | 1/1996 | Mason et al. | 210/791 |
| 5,688,336 | A | * | 11/1997 | Millard, Jr. | 134/42 |
| 6,353,130 | B1 | * | 3/2002 | Aichinger et al. | 560/205 |

FOREIGN PATENT DOCUMENTS

| | | | | |
|---|---|---|---|---|
| DE | 33 25 166 A | | 1/1985 | |
| JP | 61 192748 A | | 8/1986 | |
| JP | 05-278041 | * | 10/1993 | B29C/33/72 |
| JP | 06-100893 | * | 4/1994 | C11D/7/60 |

OTHER PUBLICATIONS

"Encyclopedia of Chemical Technology", 4th Edition, vol. 1 pp. 301–302 Dec. 1991.

* cited by examiner

*Primary Examiner*—Randy Gulakowski
*Assistant Examiner*—Gentle E. Winter
(74) *Attorney, Agent, or Firm*—Oblon, Spivak, McClelland, Maier & Neustadt, P.C.

(57) ABSTRACT

Plant parts which are used for the production or processing of (meth)acrylic esters are cleaned by (a) emptying the plant parts, (b) flushing the plant parts with aqueous 5 to 50% strength by weight alkali metal hydroxide solution, (c) removing the alkali metal hydroxide solution from the plant parts, (d) if required, washing the plant parts with water and (e) if required, drying the plant parts.

15 Claims, No Drawings

METHOD OF CLEANING PLANT PARTS FOR THE PREPARATION OR PROCESSING OF (METH)ACRYLIC ESTERS

BACKGROUND OF THE INVENTION

1. Field of the Invention

The present invention relates to a method for cleaning plant parts which are used for the preparation or processing of (meth)acrylic esters.

2. Description of the Background (Meth)acrylic esters are produced on a large industrial scale generally by esterifying (meth)acrylic acid with alkanols in the presence of strong acids and, if required, an entraining agent for removing the water of the esterification. The synthesis is preferably carried out in stirred reactors with attached distillation columns, and the working-up with the aid of a plurality of distillation columns and extraction apparatuses (cf. Kirk Othmer, Encyclopedia of Chemical Technology, 4th Ed., Vol. 1, pages 301–302). Heat is supplied and cooling effected usually by means of heat exchangers, such as plate-type, tube-bundle or spiral heat exchangers or circulation evaporators. The distillation columns are provided with baffles, such as sleve trays, bubble caps, dualflow trays or stacked packings or contain packing.

One problem in the preparation of (meth)acrylic esters is the considerable tendency of the (meth)acrylic compounds to undergo free radical polymerization, especially under the action of heat or light. Especially in the esterification, reaction temperatures from 80 to 140° C. are generally necessary in order to achieve economical esterification rates. In the purification, the necessary separation of the low-boilers and high-boilers by distillation and the isolation of the target ester require temperatures of from 60 to 150° C. Thus, the esters are exposed to terminal loads which can easily trigger an undesired polymerization. Soiling of the preparation apparatus and of the distillation columns and blockage of the lines, pumps, evaporators (fouling) and condensers by polymers are generally the result.

Particularly with the use of crude acrylic acid, which is preferred for economic reasons and also contains various carbonyl compounds, such as formaldehyde, acetaldehyde, furfurals, benzaldehyde, protoanemonin and dicarboxylic acids, such as maleic acid or itaconic acid, soiling and blockage of plant parts occur to an increasing extent.

In order to prevent the undesired free radical polymerization, inhibitors are added to the reaction mixture.

However, complete elimination of polymer formation therewith is not achievable. After an operating term of several weeks, it is therefore usually necessary to free plant parts from polymer.

Another complicating factor is that relatively high molecular weight compounds, as formed by repeated Michael addition reactions of the (meth)acrylic acid with the (meth)acrylate, increase the viscosity of the reaction mixture and facilitate the position of polymer in plant parts.

The cleaning of the plants, for example by treatment with solvents or by manual removal of the polymer, is a complicated, expensive process causing environmental pollution. The plant parts are usually cleaned by treatment with suitable organic solvents, for example dimethylformamide, dibutylformamide, dimethylacetamide, dibutylacetamide, sulfolane or N-methylpyrrolidone. The solutions obtained have to be disposed of by a complicated procedure. In addition, manual removal of the polymer, for example from distillation trays or from evaporator pipes, may be necessary.

In addition to the environmental pollution as a result of the cleaning, the polymer formation and the cleaning of the plant parts always also result in a loss of desired products, since residual amounts of starting materials and desired esters remain in the plant after emptying. Moreover, the availability of the production plant is reduced as a result of the necessary shutdown.

For economic and ecological reasons, cleaning of the plant by a different method and substantial avoidance of losses of desired products should therefore be strived for.

SUMMARY OF THE INVENTION

It is an object of the present invention to provide a method for cleaning plant parts which are used for the preparation or processing of (meth)acrylic esters, which method avoids the above disadvantages.

We have found that this object is achieved in a novel method by

DETAILED DESCRIPTION OF THE PREFERRED EMBODIMENTS (a) emptying the plant parts, (b) flushing the plant parts with aqueous 5 to 50% strength by weight alkali metal hydroxide solution, (c) removing the alkali metal hydroxide solution from the plant parts, (d) if required, washing the plant parts with water and (e) if required, drying the plant parts.

Before the washing with alkali metal hydroxide solution, the plant parts are emptied as completely as possible so that only very small amounts of reaction mixture or of substance present in the plant part remain behind.

The concentration of the alkali metal hydroxide solution used is preferably from 10 to 30% by weight, based on the weight of the prepared solution.

Preferably, the temperature of the alkali metal hydroxide solution during flushing is from 20 to 140° C., particularly preferably from 60 to 100° C. It should be ensured that the alkali metal hydroxide solution is at this temperature during contact with the polymers deposited in the plant parts. If the entire plant is heated to the corresponding temperature, the temperature of the alkali metal hydroxide solution used corresponds to this desired temperature. If plant parts are not heated to this temperature, the temperature of the alkali metal hydroxide solution used should be adjusted so that the stated temperature prevails in the areas with the polymer coating.

If necessary, the temperature of the alkali metal hydroxide solution is chosen correspondingly higher during introduction into the plant.

Sodium hydroxide is preferably used as the alkali metal hydroxide. The alkali metal hydroxide solution can be circulated through the corresponding plant parts in order to achieve a sufficiently long treatment time. The treatment time is usually from 1 to 24 hours, depending on the level of deposits in the plant parts. The treatment time, the concentration of the alkali metal hydroxide solution and the temperature depend on the type of (meth)acrylic ester used in the plant part and on the type and amount of the polymer. Usually, (meth)acrylic esters of alcohols, such as alkanols of 1 to 12, preferably 1 to 8 carbon atoms, are prepared by direct esterification or transesterification. Examples of alkanols are methanol, ethanol, n-butanol, 2-ethylhexanol and dimethylaminoethanol.

The (meth)acrylic esters can also be obtained by reacting olefins, preferably isobutene, with (meth)acrylic acid.

The plant parts to be cleaned are those plant parts which come into contact with the starting materials or products during the preparation or processing of (meth)acrylic esters, in particular during the esterification of (meth)acrylic acid with alkanols. The plant parts may be, for example, reactors, distillation columns, extraction apparatuses, heat exchangers, evaporators, condensers, pipes or pumps, which may be connected to form a unit. Preferably, the connected plant parts comprise a distillation unit which has a flushing line between the evaporator and the top of the columns. In particular, polymers formed in the preparation and processing of (meth)acrylic esters are deposited in these plant parts. The treatment with the alkali metal hydroxide solution causes or at least partly, hydrolysis of the ester groups of the (meth)acrylate polymers, resulting in liberation of the alkanol component. Inter alia, the polymer is detached from the plant parts as a result of this and goes completely or partly into solution and can thus be discharged with the alkali metal hydroxide solution from the plant parts.

To ensure that distillation apparatuses can be readily cleaned with the alkali metal hydroxide solution, they are preferably equipped with their own flushing lines. These permit the transport of the alkali metal hydroxide solution, which is heated, for example, in the evaporator of the column, to the top of the column. The flushing lines enable the top of the column and all column trays to be treated with the alkali metal hydroxide solution.

Preferably, after removal with the alkali metal hydroxide solution from the plant parts in step (c), the alcohols, in particular alkanols, formed during the cleaning are separated off from the alkali metal hydroxide solution in which they are present by phase separation, distillation or stripping. If its water solubility is low, the resulting alkanol forms a second phase which can readily be separated from the alkali metal hydroxide solution. If it is a water-soluble alkanol, it is preferably separated off by distillation or by stripping with a stripping gas, such as air or steam. The distillative separation and the stripping can be carried out, for example, in a heatable stirred reactor with an attached column. The energy may be supplied in a known manner, for example by double-walled heaters, coiled tubes or circulation heaters. The alkanol can be stripped in a stripping column in a known manner. For example, the preferably hot alkali metal hydroxide solution can be fed in at the top of the column after the flushing and can be stripped with air or steam by the countercurrent method. The condensation of the distillate or of the alkanol from the stripping gas can be effected by means of known cooling apparatuses, such as tube-bundle or plate-type heat exchangers.

The stripping is preferably carried out in the stripping unit, which is present as a rule in every plant for the production of (meth)acrylic esters and in which customarily occurring alkanol-containing waste waters are stripped. The alcohol, in particular alkanol, can be recycled directly to the esterification reaction after being separated off.

Since, as a rule, only a part of the alkali metal hydroxide solution used is consumed during the cleaning, the alkali metal hydroxide solution can be collected after the cleaning and used several times for cleaning. However, the concentration of alkali metal hydroxide should preferably not fall below 5% by weight, in order to avoid a deterioration in the cleaning performance.

The novel process can be carried out easily and rapidly, with the result that the plant availability is increased.

Moreover, desired products, particularly alkanols, can be recovered.

The example which follows illustrates the invention.

EXAMPLE

Cleaning of a Distillation Column

The distillation column used was a dualflow column for the distillation of reaction mixtures obtained in the esterification of (meth)acrylic acid with alkanols. After indication of soiling of the column trays for the distillation column, detectable by the increase in the pressure difference between the bottom of the column and the top of the column, the distillation process was stopped and the distillation unit emptied. The corresponding evaporator was then filled with 20% strength by weight aqueous NaOH solution. The NaOH solution was heated to 80° C. and applied to the top column tray via a flushing line. After a treatment time of 5 hours with this hot solution at a circulation rate of about 10 $m^3/h$, said solution was pumped into a storage container and the distillation unit was flushed with water and, if necessary, dried with air.

After the distillation column had been put into operation again, the pressure difference was normal again.

Recovery of the Alkanol

A flushing solution which was obtained during the cleaning of a plant for the production of butyl acrylate and contained about 7% by weight of NaOH and about 5% by weight of butanol was fed at 60° C. to the top of a stripping column which had 30 dualflow trays and was stripped with steam by the countercurrent method (0.2 $t/m^3$). The resulting condensate separated into two phases, the aqueous phase being fed to the top of the column again. The organic phase, the butanol, was fed directly to the esterification. About 90% of the butanol were recovered.

We claim:

1. A method for cleaning plant parts for producing or processing (meth)acrylic esters, which comprises the steps of:

a) emptying plant parts in which producing or processing of (meth)acrylic esters has been carried out;

b) flushing the plant parts with aqueous 5 to 30% strength by weight of alkali metal hydroxide solution, which solution consists of water and sodium hydroxide; and c) removing the sodium hydroxide solution from the plant parts.

2. The method of claim 1, which further comprises the step of:

d) washing the plant parts of step c) with water.

3. The method of claim 2, which further comprises the step of:

e) drying the plant parts of step d).

4. The method of claim 1, wherein said sodium hydroxide solution has a strength of from 10 to 30% by weight.

5. The method of claim 1, wherein the sodium hydroxide solution has a temperature of from 20 to 140° C. during the flushing.

6. The method of claim 5, wherein the temperature of the sodium hydroxide solution during the flushing is 60 to 100° C.

7. The method of claim 1, wherein the plant parts are selected from the group consisting of reactors, distillation columns, extraction apparatii, heat exchangers, evaporators, condensers, pipes and pumps, which are optionally connected to form a unit.

8. The method of claim 7, wherein said plant parts are connected to form a unit, the unit comprising a distillation unit which has a flushing line between the evaporator and the top of the columns.

9. The method of claim 1, wherein the plant parts are cleaned to remove deposited polymers formed in the producing or processing of (meth)acrylic esters.

10. The method of claim 8, wherein alcohols containing the alkali metal hydroxide solution after step c) are separated from said solution by phase separation, distillation or stripping and, optionally, are recycled to an esterification for the production of (meth)acrylic esters.

11. A The method of claim 1, wherein the alkali metal hydroxide solution is collected after the flushing and used several times thereafter for further cleaning.

12. The method of claim 1, wherein the plant parts are cleaned to remove residues from the production of (meth) acrylic esters by reaction of (meth)acrylic acid with alcohols or olefins or by reacting (meth)acrylic esters with alcohols.

13. The method of claim 4, wherein said sodium hydroxide solution has a strength of 20% by weight.

14. The method of claim 1, wherein said flushing of step b) is effected for from 1 to 24 hours.

15. The method of claim 9, wherein said plant parts are cleaned to remove deposited polymers formed in the producing or processing of butyl acrylate.

* * * * *

UNITED STATES PATENT AND TRADEMARK OFFICE

CERTIFICATE OF CORRECTION

PATENT NO. : 6,568,406 B2
DATED : May 27, 2003
INVENTOR(S) : Aichinger et al.

It is certified that error appears in the above-identified patent and that said Letters Patent is hereby corrected as shown below:

Title page,
Items [45] and [*] Notice, should read as follows:

-- [45] **Date of Patent: *May 27, 2003**

[*] Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days. --

Signed and Sealed this

Eighth Day of March, 2005

JON W. DUDAS
*Director of the United States Patent and Trademark Office*